US009573182B2

(12) United States Patent
Laib

(10) Patent No.: US 9,573,182 B2
(45) Date of Patent: Feb. 21, 2017

(54) REPROCESSED DIES

(71) Applicant: TRUMPF Werkzeugmaschinen GmbH + Co. KG, Ditzingen (DE)

(72) Inventor: Wolfgang Laib, Besigheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 80 days.

(21) Appl. No.: 14/220,576

(22) Filed: Mar. 20, 2014

(65) Prior Publication Data

US 2014/0202298 A1 Jul. 24, 2014

Related U.S. Application Data

(62) Division of application No. 12/579,812, filed on Oct. 15, 2009, now Pat. No. 8,701,532.

(30) Foreign Application Priority Data

Oct. 18, 2008 (EP) ..... 08018279

(51) Int. Cl.

| | |
|---|---|
| ***B21D 37/08*** | (2006.01) |
| ***B21D 28/14*** | (2006.01) |
| ***B21D 28/24*** | (2006.01) |
| ***B21D 28/34*** | (2006.01) |

(52) U.S. Cl.

CPC ..... *B21D 37/08* (2013.01); *B21D 28/14* (2013.01); *B21D 28/246* (2013.01); *B21D 28/34* (2013.01); *Y10T 29/49716* (2015.01); *Y10T 83/0524* (2015.04); *Y10T 83/8727* (2015.04); *Y10T 83/8733* (2015.04); *Y10T 83/9423* (2015.04)

(58) Field of Classification Search

CPC ..... B21D 28/14; B21D 28/34; B21D 28/246; B21D 37/08; Y10T 29/49716; Y10T 83/8727; Y10T 83/9423; Y10T 83/0524; Y10T 83/8733

USPC ..... 83/39, 76.9, 255, 550, 257, 40, 555, 45, 83/52, 203, 684–688, 212.1, 357, 356.2, 83/549, 537, 553; 29/564, 563, 568, 50; 72/455, 456, 442, 446; 234/1; 408/31, 1, 408/49; 700/176

See application file for complete search history.

(56) References Cited

U.S. PATENT DOCUMENTS

| | | | | |
|---|---|---|---|---|
| 552,953 | A * | 1/1896 | Bradley | B61G 3/04 213/124 |
| 1,728,475 | A * | 9/1929 | Cavill | B26F 1/04 83/468 |
| 2,364,011 | A * | 11/1944 | Wales | B21D 28/002 100/266 |
| 2,369,896 | A | 2/1945 | Harris et al. | |
| 2,893,489 | A | 7/1959 | Thompson | |

(Continued)

FOREIGN PATENT DOCUMENTS

| | | |
|---|---|---|
| DE | 3441530 | 5/1986 |
| DE | 4026119 | 2/1991 |

(Continued)

OTHER PUBLICATIONS

European Search Report from corresponding European Application No. EP 08018279, mailed Apr. 27, 2009, 13 pages.

*Primary Examiner* — Ghassem Alie
(74) *Attorney, Agent, or Firm* — Fish & Richardson P.C.

(57) ABSTRACT

A method includes removing material from a die and thereby changing a location of a cutting edge of the die in a punch entry direction and changing a cutting edge cross-section of the die; and assigning a punch and/or a workpiece thickness to the die based, at least in part, on the change in the cutting edge cross-section of the die.

5 Claims, 5 Drawing Sheets

(56) References Cited

U.S. PATENT DOCUMENTS

| | | | | | |
|---|---|---|---|---|---|
| RE25,463 | E | | 10/1963 | Skoog | |
| 3,358,538 | A | | 12/1967 | Maceyka | |
| 3,682,122 | A | | 8/1972 | Haddon et al. | |
| 4,250,731 | A | | 2/1981 | Cremer | |
| 4,516,450 | A | | 5/1985 | Shuttleworth | |
| 4,532,843 | A | * | 8/1985 | Miyama | B21D 28/246 83/409 |
| 4,543,865 | A | * | 10/1985 | Kramski | B21D 28/145 83/146 |
| 5,046,232 | A | | 9/1991 | Mise | |
| 5,305,557 | A | | 4/1994 | Warncke | |
| 6,401,056 | B1 | | 6/2002 | Sirois | |
| 2002/0139229 | A1 | | 10/2002 | Yamamoto | |

FOREIGN PATENT DOCUMENTS

| | | | |
|---|---|---|---|
| DE | 20020499 | | 4/2001 |
| DE | 102005005214 | | 8/2006 |
| DE | 102006049044 | | 4/2008 |
| EP | 0580124 | | 1/1994 |
| EP | 1445042 | | 8/2004 |
| EP | 1634663 | | 3/2006 |
| EP | 0875310 | | 10/2009 |
| GB | 2169233 | | 7/1986 |
| JP | 5725701 | A | 2/1982 |
| JP | 360822 | A | 3/1991 |
| JP | 4319029 | A | 11/1992 |
| JP | 6106256 | A | 4/1994 |
| JP | 7164073 | A | 6/1995 |
| JP | 10202330 | A | 8/1998 |
| JP | 10277662 | A | 10/1998 |
| JP | 2002273530 | A | 9/2002 |
| JP | 2007007703 | | 1/2007 |
| JP | 2007245165 | A | 9/2009 |
| WO | WO0243892 | | 6/2002 |
| WO | WO2008049079 | | 4/2008 |

* cited by examiner

REPROCESSED DIES

CROSS REFERENCE TO RELATED APPLICATIONS

This application is a divisional of and claims the priority of U.S. Ser. No. 12/579,812 ,filed Oct. 15, 2009 ,which claims priority under 35 U.S.C. §119(a) from European Patent Application No. 08 018 279.3 ,filed Oct. 18, 2008 ,the entire contents of which are hereby incorporated by reference.

TECHNICAL FIELD

The invention relates to reprocessed dies, and, in particular, to the assignment of a punch or a workpiece thickness to a reprocessed die.

BACKGROUND

U.S. Pat. No. 6,401,056 B1 describes the recording of information about punching tools during the lifetime of a tool. A record is made of regrinding operations performed on dies and of a changing size of a height of the die that is associated with regrinding. The recorded tool data are intended, in particular, to enable the tool user to determine when a punching tool needs to be repaired or replaced.

The dies normally used in practice are dies having a die orifice whose wall extends at a so-called "relief angle" with respect to the wall of the punch entering the die orifice. The relief angle is intended to ensure that the material which is punched out can reliably leave the die and that the punch can return to its home position without hindrance following penetration of the workpiece to be processed and following associated entry into the die orifice of the die. To obtain the highest possible process reliability during punching, the relief angle on dies would have to be as large as possible.

Regrinding of dies is typically carried out because of wear to the cutting edge of the die and involves removal of material from the die in the entry direction of the punch. Owing to the relief angle, the removal of material is accompanied by enlargement of the cross-section of the die orifice at the level of the cutting edge of the die ("die cutting edge cross-section"). At the same time, the die cutting edge cross-section is a determining factor for assignment of the die to a punch cooperating therewith ("punch assignment") and/or for the thickness of the workpiece that can be processed by means of the die and the punch assigned thereto ("workpiece thickness assignment"). For example, in the case of a punching tool set comprising a punch of circular cross-section and a die with a die orifice of circular cross-section, ideally a cutting gap of a width dependent on the thickness of the material to be processed remains between the cutting edge of the die and the punch. If, for example, a circular cut-out of 5 mm diameter is to be made in a metal sheet of 2 mm thickness, there is provided for that purpose a punching tool set comprising a round punch with a diameter of 5 mm and a die with a circular die orifice, the cutting edge of which die has a diameter of 5.2 mm.

For individual processing tasks, for example for a specific thickness of metal sheet and for a specific punching diameter, users of punching tools keep a stock of punching tool sets specifically designed for the particular processing task. Regrinding of the die of such a punching tool set, for example because of wear to the cutting edge of the die, is envisaged only on a scale such that the enlargement of the die cutting edge cross-section, which is associated with regrinding of the die, does not result in an unduly wide cutting gap being produced between the cutting edge of the die and the assigned punch.

Owing to the relief angle of the die, however, the die cutting edge cross-section is typically widened, even as a result of a slight regrinding of the die, to a value that should not be exceeded for a given punch if high-quality processing results are to be achieved. In the case of an unduly wide cutting gap, only processing results of an inferior quality would be achievable using the punching tool set. Once the size of the die cutting edge cross-section reaches its limit value, further regrinding is usually abandoned and the die is instead removed from stock and scrapped.

SUMMARY

In general, this invention relates to reprocessed dies, and, in particular, to the assignment of a punch or a workpiece thickness to a reprocessed die.

One aspect of the invention features a method that includes removing material from a die and thereby changing a location of a cutting edge of the die in a punch entry direction and changing a cutting edge cross-section of the die. The method also includes assigning a punch and/or a workpiece thickness to the die based, at least in part, on the change in the cutting edge cross-section of the die.

In some embodiments, changing the cutting edge cross-section of the die includes changing a size of the cutting edge cross-section of the die. The punch and/or the workpiece thickness can be assigned based, at least in part, on the change in the size of the cutting edge cross-section.

In certain embodiments, the die includes a relief angle at which a wall of the die extends in the punch entry direction. The punch and/or the workpiece thickness can be assigned based, at least in part, on the relief angle.

In some embodiments, changing the cutting edge cross-section of the die includes changing a shape of the cutting edge cross-section of the die. The punch and/or the workpiece thickness can assigned based, at least in part, on the change in the shape of the cutting edge cross-section.

The method can also include arranging the die and an assigned punch in a working state on tool supports of a punching apparatus of a punching machine.

In certain embodiments, arranging the die and the assigned punch in the working state on the tool supports of the punching apparatus includes arranging the die and an assigned punch on a common tool holder located in a position away from the punching apparatus, and then utilizing the common tool holder to arrange the die and the assigned punch on the tool supports of the punching apparatus.

In some embodiments, arranging the die and the assigned punch in the working state on the tool supports of the punching apparatus includes positioning the die and the assigned punch relative to each other on the tool supports of the punching apparatus.

In certain embodiments, arranging the die and the assigned punch in the working state on the tool supports of the punching apparatus includes positioning the die along a stroke axis of the punching apparatus based, at least in part, on a depth of material removed from the die.

The method can also include performing a punching operation on a workpiece using the punching machine and the die.

Another aspect of the invention provides a reprocessed die. A height of the reprocessed die, measured in a punch entry direction, differs from a height, in the punch entry direction, of a predecessor die that was reprocessed to produce the reprocessed die. The reprocessed die is provided with a punch assignment and/or a workpiece thickness assignment based, at least in part, on a change in a cutting edge cross-section of the reprocessed die relative to the predecessor die.

In another aspect, the invention features a punch machine that includes a reprocessed die and a control unit. The control unit is configured to assign a punch or a workpiece thickness to the reprocessed die based, at least in part, on a change in a cutting edge cross-section of the reprocessed die relative to a predecessor die that was reprocessed to produce the reprocessed die.

The punch machine can also include a plurality of punches. The control unit can be configured to assign one of the plurality of punches to the reprocessed die based, at least in part, on the change in the cutting edge cross-section of the reprocessed die relative to the predecessor die.

In some embodiments, the punch machine includes a punch assembly including a plurality of punches. The control unit can be configured to assign one of the punches of the punch assembly to the reprocessed die based, at least in part, on the change in the cutting edge cross-section of the reprocessed die relative to the predecessor die.

In certain embodiments, the punch machine also includes a punch assembly including a plurality of punches, and an adjusting device. The adjusting device is operable to position the punch assembly and the reprocessed die relative to each other based, at least in part, on the punch assignment or the workpiece thickness assignment of the reprocessed die.

In some embodiments, the adjusting device is in communication with the control unit, and the control unit is configured to position one of the punches and the reprocessed die in a working state via operation of the adjusting device.

In certain embodiments, the control unit is configured to control relative movement of the punch assembly and the reprocessed die, via the adjusting device, based, at least in part, on the punch assignment or the workpiece thickness assignment of the reprocessed die.

The punch machine can also include an elevating device operable to position the reprocessed die along a stroke axis of the punch machine.

In some embodiments, the elevating device is in communication with the control unit, and the control unit is configured to control movement of the reprocessed die along the stroke axis of the punch machine via the elevating device based, at least in part, on a depth of material removed from the predecessor die.

Another aspect of the invention provides a punch machine that includes a die assembly including a plurality of reprocessed dies, and a control unit. The control unit is configured to assign a corresponding punch and/or a corresponding workpiece thickness to each of the reprocessed dies of the die assembly based, at least in part, on respective changes in cutting edge cross-sections of the reprocessed dies relative to predecessor dies that were reprocessed to produce the reprocessed dies.

The punch machine can also include a punch assembly including a plurality of punches, and an adjusting device. The adjusting device is operable to position the punch assembly and the die assembly relative to each other based, at least in part, on the punch assignments or the workpiece thickness assignments of the reprocessed dies.

In certain embodiments, the adjusting device is in communication with the control unit, and the control unit is configured to position one of the punches and one of the reprocessed dies in a working state via operation of the adjusting device.

In some embodiments, the control unit is configured to control relative movement of the punch assembly and the die assembly, via the adjusting device, based, at least in part, on the punch assignments or the workpiece thickness assignments of the reprocessed dies.

The punch machine can also include an elevating device operable to position the die assembly along a stroke axis of the punch machine.

In certain embodiments, the elevating device is in communication with the control unit, and the control unit is configured to control movement of the die assembly along the stroke axis of the punch machine via the elevating device based, at least in part, on a depth of material removed from the predecessor dies.

In yet another aspect the invention features a computer readable medium having encoded thereon software for defining punching tool sets. The software includes instructions for assigning a punch or a workpiece thickness to a reprocessed die based, at least in part, on a change in a cutting edge cross-section of the reprocessed die relative to a predecessor die that was reprocessed to produce the reprocessed die.

The software can also include instructions for receiving information corresponding to a depth of material removed from a predecessor die as a result of the reprocessing of the predecessor die, and determining the change in the cutting edge cross-section of the reprocessed die relative to the predecessor die based on the depth of material removed from the predecessor die and a relief angle associated with the predecessor die.

In another aspect, the invention features a method for defining a punching tool set for processing workpieces, such as metal sheets, by punching. A punching tool set is assembled from a punch and from a die. The die is produced by reprocessing of a predecessor die. A change in a die cutting edge cross-section associated with the reprocessing is taken into consideration during the assembly the of the punching tool set. Starting with the die cutting edge cross-section of the predecessor die, the die cutting edge cross-section of the die (produced by reprocessing) is obtained by means of the change in the die cutting edge cross-section associated with the reprocessing. The new die cutting edge cross-section (i.e., the cutting edge cross-section of the reprocessed die) forms the basis for a punch assignment and/or a workpiece thickness assignment of the die. It is conceivable that, owing to the reprocessing operation and the associated removal of material, the die may be assigned to a different punch than the predecessor die. In addition or as an alternative, the die may be assigned to a different workpiece thickness than the predecessor die. In each case it is ensured that a reprocessed, e.g., reground, die is used for forming punching tool sets. The reduction or elimination of a rigid association of dies with specific punches and/or specific workpiece thicknesses can help to increase the useful life of the dies.

In some embodiments, a punching tool can be defined under numerical control.

In certain embodiments, the method for defining punching tool sets can be integrated in a method for managing punching tool sets for processing workpieces, especially metal sheets, by punching. Such integration can be beneficial in view of the fact that the tool data utilized for defining punching tool sets is also available for managing punching tools.

In some embodiments, the method for defining punching tool sets can be used when setting up punching apparatuses on punch machines. Thus, when setting up a punching apparatus, a punching tool set, with which the punching apparatus is to be equipped, is defined.

In some cases, the method for defining punching tool sets and the method for setting up punching apparatuses on punch machines can be integrated in a method for processing workpieces, such as metal sheets, by punching. In the course of such a processing method, punching tools that are to be used for workpiece processing can be determined and installed on a punching apparatus of a punch machine before actual processing of a workpiece can be commenced.

In some embodiments, a die is provided with a punch assignment and/or a workpiece thickness assignment in dependence on a change in the die cutting edge cross-section associated with reprocessing of the die. Such a die can be used in a punch machine.

The punch machine can be operated under numerical control. A processing program can be run on a numerical control of the punch machine to control adjusting devices and an elevating device of the punch machine, thereby to control movements of the die and an assigned punch A change in a die cutting edge cross-section associated with a processing of a predecessor die may differ in nature. For example, in some cases, reprocessing of the predecessor die results in alteration of a size of the die cutting edge cross-section. Accordingly, a punch assignment and/or a workpiece thickness assignment of the reprocessed die can be carried out in dependence on the change in the size of the die cutting edge cross-section associated with the reprocessing.

A reason for a change in the size of the die cutting edge cross-section due to reprocessing may be a relief angle at which, on the predecessor die, the wall of the die orifice extends with respect to the wall of the punch entering the die orifice. In that case, the punch assignment and/or the workpiece thickness assignment of the die can be based on the value of the relief angle. Using simple trigonometric functions, the change in size of the die cutting edge cross-section associated with reprocessing can be determined from the relief angle and from the depth of the material removed in the entry direction of the punch during the reprocessing. By reference to the change in size, the size of the die cutting edge cross-section obtained as a result of the reprocessing can be ascertained based on the original size of the die cutting edge cross-section.

Alternatively or additionally, the reprocessing of the predecessor die can result in a change in a shape of the die cutting edge cross-section. Accordingly, the punch assignment and/or the workpiece thickness assignment can be carried out in dependence on the change in the shape of the die cutting edge cross-section associated with the reprocessing.

The punching tool sets defined in the manner described can be arranged on a punching apparatus of a punch machine in such a manner that they are able to perform the desired workpiece processing. A tool holder can be used for that purpose. The die and the punch of a defined punching tool set can be arranged on the tool holder at a location away from the punching apparatus. The punching tool set can then be transferred to the punching apparatus of the punch machine by means of the tool holder.

In addition or as an alternative, there is the possibility of bringing the die and the punch of a defined punching tool set into a working state on tool supports of the punching apparatus. For example, the die and the punch can be positioned relative to each other on the tool supports of the punching apparatus in such a way as to provide a mutual assignment of die and punch for subsequent workpiece processing.

When the die is arranged on the punching apparatus of the punch machine, the removal of material from the die, which is associated with the reprocessing of the predecessor die, can be taken into consideration. Owing to the removal of material, the height of the die measured in an entry direction of the punch (i.e., the punch entry direction) is reduced and the location of the cutting edge of the die changes accordingly. The vertical location of the cutting edge of the die on the upper side of the die facing the punch can be significant for workpiece processing in a number of respects. For example, the vertical location of the cutting edge of the die may be necessary to calculate the magnitude of the punch stroke to be carried out by the punch. It may also be necessary to ensure that the upper side of the die does not project above a workpiece support on which the workpiece is supported in the vicinity of the punching apparatus. The aspects mentioned are taken into consideration in setting up the punching apparatus of a punch machine by the die being positioned on the punching apparatus of the punch machine in the entry direction of the assigned punch according to the depth to which material was removed during the reprocessing.

For relative positioning of the die and punch of a defined punching tool set, appropriate adjusting devices are provided on punch machines according to the invention.

If the punch assigned to a die forms part of a punch assembly that includes a plurality of punches, the adjusting device serves to position the punch assembly and the die relative to each other in such a manner as to enable the die and the punch of the defined punching tool set to perform the relevant workpiece processing in cooperation with each other.

If the die is a component part of a die assembly that includes a plurality of dies, the die assembly on the one hand and the punch of the defined punching tool set on the other hand are positioned in such a manner that the die of the defined punching tool set and the assigned punch are operable.

The height adjustment of the die on the punching apparatus of the punch machine, which is carried out in dependence on the depth of the material removed during the reprocessing, can be implemented by means of an appropriate elevating device of the punch machine.

Other aspects, features, and advantages will be apparent from the description and drawings, and from the claims.

DETAILED DESCRIPTION

Figure 1:
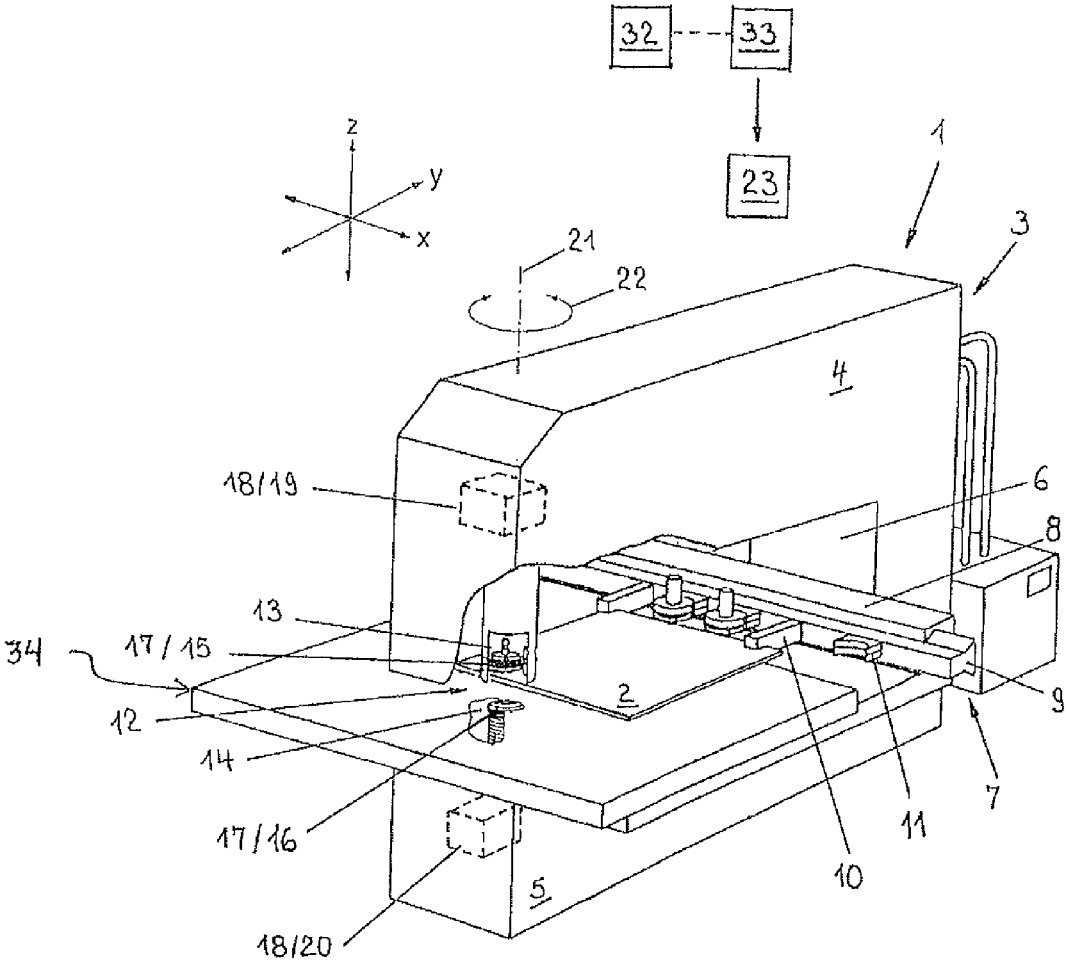
FIG. 1 is a perspective view of a punch machine.

As shown in FIG. 1, a punch machine 1, for processing workpieces in the form of metal sheets 2 by punching, has a C-shaped machine frame 3 with an upper frame member 4 and a lower frame member 5. A conventional coordinate guide 7 is accommodated in a throat 6 of the machine frame 3. As is customary, the coordinate guide 7 comprises a transverse rail guide 8 and a transverse rail 9 guided thereon. The transverse rail guide 8 is displaceable together with the transverse rail 9 in the direction of a horizontal y axis by means of a drive motor. The transverse rail 9 can be moved in the direction of a horizontal x-axis, which at the same time is perpendicular to the y-axis, by means of a drive motor.

Clamps 10 of a conventional type are provided on the transverse rail 9 for holding a workpiece (e.g., metal sheet 2). The metal sheet 2 is supported on a workpiece support 34 of the punch machine 1. In addition, the transverse rail 9 serves as a tool magazine. For that purpose, tool holders 11 are detachably mounted on the transverse rail 9. A tool holder 11 is illustrated in detail in FIG. 7.

At the free ends of the upper frame member 4 and the lower frame member 5, there is a punching apparatus configured as a punching station 12. The punching station 12 is a mono-punching head. Accordingly, the punching station 12 includes tool supports in the form of an upper tool receiver 13 on the upper frame member 4 and in the form of a lower tool receiver 14 on the lower frame member 5.

In the example illustrated, a punch 15 is loaded into the upper tool receiver 13 and a die 16 is loaded into the lower tool receiver 14. The punch 15 and the die 16 form together a punching tool set 17. The die 16 is illustrated in detail in FIGS. 2*a*, 2*b*, 2*c*. FIG. 7 shows the die 16 in combination with the punch 15.

An electric rotary/stroke drive 18 of the punch machine 1 comprises an upper electric rotary/stroke drive unit 19 and a lower electric rotary/stroke drive unit 20. By means of the upper rotary/stroke drive unit 19, the punching tool loaded into the upper tool receiver 13, in this case the punch 15, is raised and lowered along a stroke axis 21 extending in the direction of a vertical z-axis and, in addition, is rotated about the stroke axis 21 in a rotation direction 22 illustrated by a double-headed arrow. Correspondingly, the punching tool loaded into the lower tool receiver 14, the die 16 here, can be translated along the stroke axis 21 and rotated about the stroke axis 21 in the rotation direction 22 by means of the lower rotary/stroke drive unit 20.

In some cases, all of the major functions of the punch machine 1 can be numerically controlled. A CNC control 23 indicated in FIG. 1 is provided for that purpose.

Figure 2A:
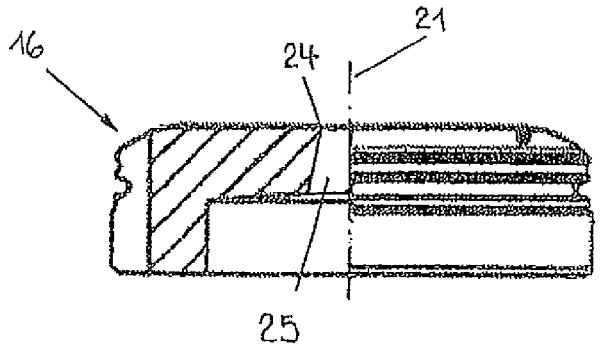
FIGS. 2*a*, 2*b*, and 2*c* show a die for use on the punch machine of FIG. 1.
Figure 2B:
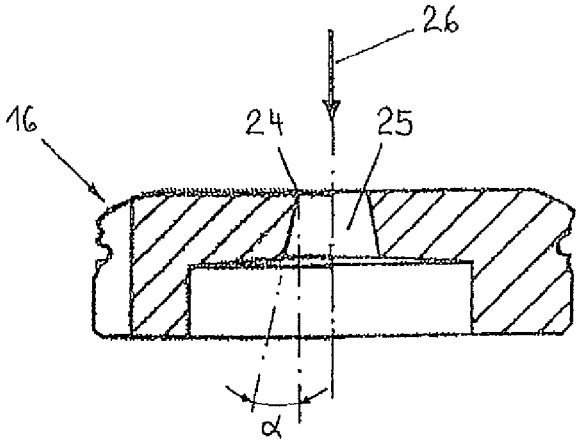

As shown in FIGS. 2*a*, 2*b*, the die 16 is of a conventional type. It has a cutting edge 24, which is circular in the case illustrated and which in turn delimits a die orifice 25 of circular cross-section. In the installed position on the punch machine 1, the die orifice 25 extends in the direction of the stroke axis 21. The punch 15 enters the die orifice 25 along the stroke axis 21 during processing of a metal sheet. An arrow 26 in FIG. 2*b* represents the entry direction. In the conventional manner, during processing of a metal sheet by punching, the cutting edge 24 of the die 16 and a corresponding circular cutting edge of the punch cooperate with each other to process the relevant metal sheet 2 by punching.

Starting at the level of the cutting edge 24 of the die, the die orifice 25 becomes wider in the entry direction 26 to form a relief angle α, which is highly exaggerated in the drawing. Accordingly, the die orifice 25 has a frustoconical shape. The relief angle α is intended to ensure that pieces cut out of a processed metal sheet 2 by means of the cutting edge 24 of the die reliably exit from the die 16 in a downward direction.

Figure 2C:
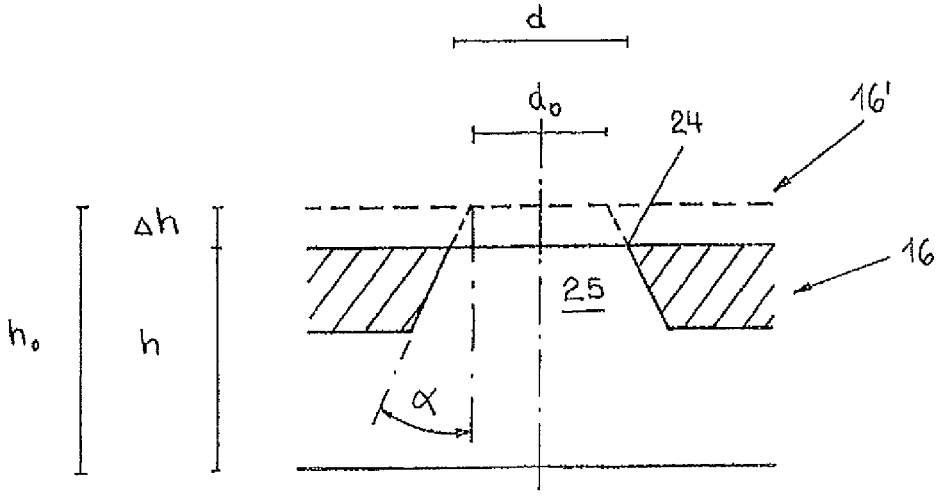

In FIG. 2*c*, the magnitude of the diameter of the die orifice 25 at the level of the cutting edge 24 of the die and hence the size of the die cutting edge cross-section is denoted by "d" and the height of the die 16 measured along the stroke axis 21 is denoted by "h".

As indicated by a dashed line in FIG. 2*c*, the die 16 has been produced by reprocessing a predecessor die 16' of height $h_0$. In the course of that reprocessing, the die 16' was reground owing to wear to the cutting edge of the die. In that operation, material having a removal depth of Δh was removed from the predecessor die 16' in the entry direction 26. Owing to the relief angle α, the removal of material was accompanied by enlargement of the die cutting edge cross-section or the die cutting edge diameter from $d_0$ to d. The increase in diameter can be determined using simple trigonometric functions.

For example, the increase in the die cutting edge diameter is given by $$\Delta d = d - d_0 = 2 * \tan\alpha * \Delta h \text{ ,where } \Delta h = h_0 - h.$$

A corresponding enlargement of the diameter of the cutting edge 24 of the die will be obtained when the die 16 is reground again by the amount Δh starting from its dimensions shown in FIGS. 2*a*, 2*b*, and 2*c*.

Figure 4A:
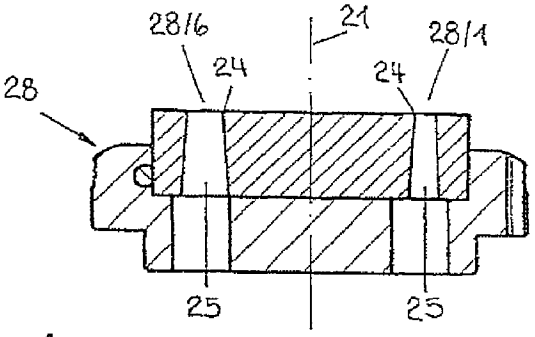
FIGS. 4*a* and 4*b* show a die assembly of a second type for use on the punch machine of FIG. 1.
Figure 4B:
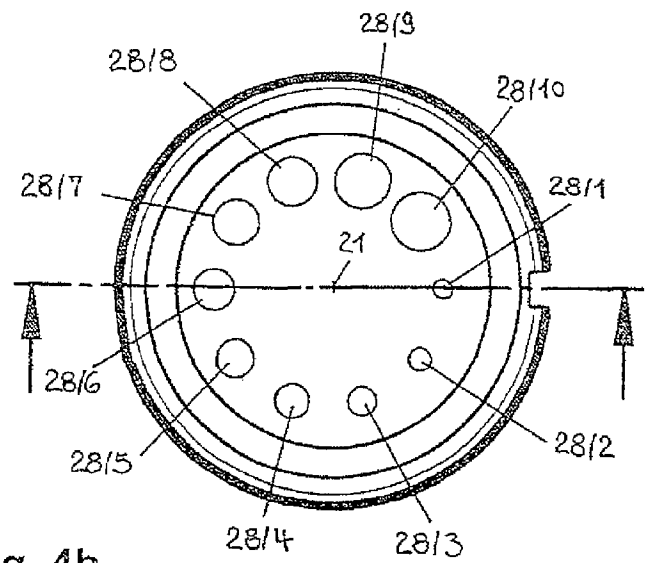
Figure 3A:
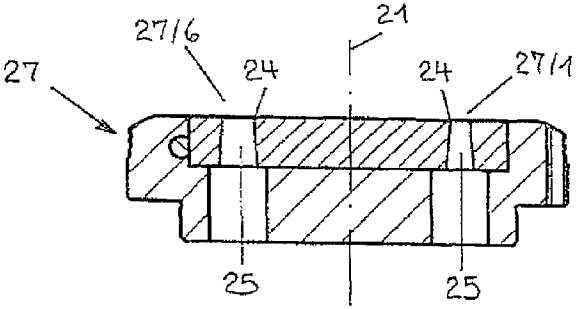
FIGS. 3*a* and 3*b* show a die assembly of a first type for use on the punch machine of FIG. 1.
Figure 3B:
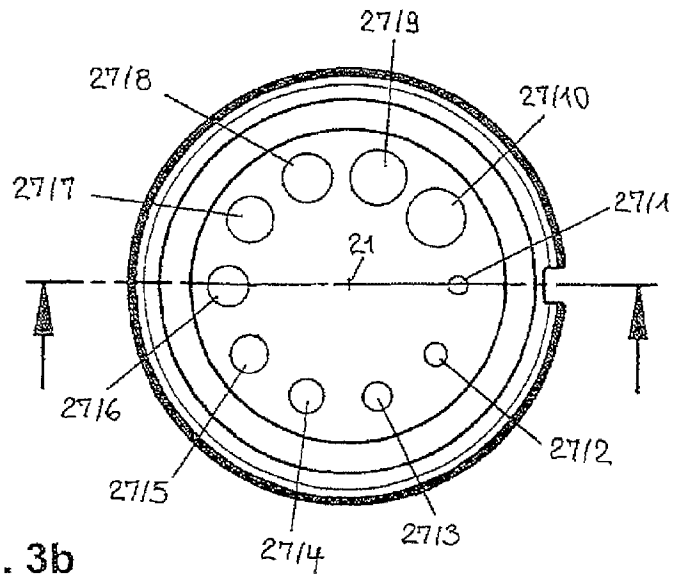

The same effect is obtained with the removal of material from cutting plates in the form of die assemblies 27, 28 shown in FIGS. 3*a*, 3*b* and 4*a*, 4*b*. FIGS. 3*a*, 4*a* show the die assemblies 27, 28 in section along the lines of sections indicated in FIGS. 3*b*, 4*b*.

Integrated into each of the die assemblies 27, 28, are ten dies 27/1 . . . 27/10 and 28/1 . . . 28/10, respectively. Each of those dies has a die orifice 25 with a cutting edge 24 of the kind described with reference to FIGS. 2*a*, 2*b*, 2*c*. The die orifice 25 of each die 27/1 . . . 27/10, 28/1 . . . 28/10 forms a relief angle α. The die assemblies 27, 28 are otherwise identical in construction to a large extent. The only structural difference resides in a greater height of the die assembly 28 as compared with the die assembly 27. The die assembly 28 thereby offers a greater regrinding reserve.

The orientation of the stroke axis 21, which at the same time forms a rotation axis, is indicated in FIGS. 3*a*, 3*b* and 4*a*, 4*b*. The die orifices 25 of the dies 27/1 . . . 27/10, 28/1 . . . 28/10 are arranged with their centre points on a circular arc about the stroke/rotation axis 21.

In dependence on the size of the die cutting edge cross-section or diameter d, the die 16 shown in FIGS. 2*a*, 2*b*, 2*c* and the dies 27/1 . . . 27/10 and 28/1 . . . 28/10 shown in FIGS. 3*a*, 3*b* and 4*a*, 4*b* are assigned to a specific punch ("punch assignment") and/or to a specific workpiece thickness ("workpiece thickness assignment")—in the present case to a specific thickness of metal sheet ("sheet thickness assignment").

A determining factor for the punch assignment and for the sheet thickness assignment of the die 16, 27/1 . . . 27/10, 28/1 . . . 28/10 is the processing task that is to be accomplished.

If, for example, circular cut-outs are to be made in metal sheets, the punch assignment and/or the workpiece thickness assignment of a die is carried out in dependence on the diameter of the cut-out to be made and, in addition, in dependence on the thickness of the metal sheet that is be processed by punching. The diameter of the cut-out that is to be made dictates the corresponding punch diameter of the punch that is to be used. The thickness of the metal sheet to be processed is a determining factor in the respect that, with a view to achieving reliable workpiece processing, the die cutting edge diameter can exceed the punch diameter of the punch to be combined with the die by an amount dependent on the thickness of the metal sheet to be processed.

In view of those relationships, a change in the die cutting edge diameter, as occurs as a result of regrinding dies having a relief angle, may require a change to the punch assignment and/or the sheet thickness assignment of the corresponding die.

Figure 5:
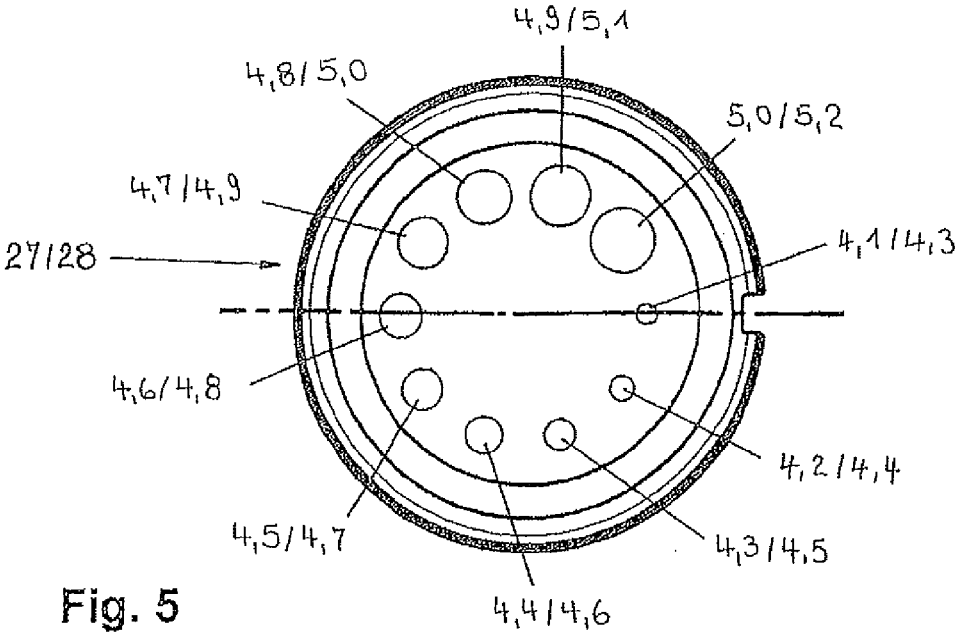
FIG. 5 illustrates a punch assignment and/or a sheet thickness assignment of dies of the die assembly of FIGS. 3*a* and 3*b*.

FIG. 5 illustrates the die assembly 27 and the die assembly 28, which in this view is identical to the die assembly 27. Near the die orifices 25 of the dies 27/1 . . . 27/10, 28/1 . . . 28/10 the respective die cutting edge diameter before and after a regrinding operation is indicated. The die cutting edge diameter of the individual dies 27/1 . . . 27/10, 28/1 . . . 28/10 has accordingly been enlarged by 0.2 mm in each case owing to the removal of material associated with regrinding.

If the punch assignment of the dies 27/1 . . . 27/10, 28/1 . . . 28/10 remained the same regardless of the regrinding operation, only the sheet thickness assignment of the dies 27/1 . . . 27/10, 28/1 . . . 28/10 may have to be changed. If a round punch having a nominal diameter of 4 mm were used, sheet thicknesses of 3 mm, 4 mm . . . 12 mm could be processed with the dies 27/1 . . . 27/10, 28/1 . . . 28/10 following regrinding instead of sheet thicknesses 1 mm, 2 mm . . . 10 mm before regrinding.

If the sheet thickness assignment of the dies 27/1 . . . 27/10, 28/1 . . . 28/10 is retained despite regrinding of the die assemblies 27, 28, then the punch assignment of the dies 27/1 . . . 27/10, 28/1 . . . 28/10 may have to be changed. If sheet thicknesses of 1 mm, 2 mm . . . 10 mm are to be processed also following the reprocessing, then following reprocessing the dies 27/1 . . . 27/10, 28/1 . . . 28/10 have to be assigned to a punch having a punch diameter of 4.2 mm.

In addition to changes to the workpiece thickness assignment alone or to the punch assignment alone, changes to both the workpiece thickness assignment and the punch assignment are conceivable. A large number of assignment changes are possible.

A punch assignment and/or a sheet thickness assignment of the dies 16, 27/1 . . . 27/10, 28/1 . . . 28/10 can be carried using computer-assisted tool management. The essential data of the tools kept in stock by a user of the punch machine 1 is stored in a data memory of a numerical tool management system 32 (FIG. 1). The data stored comprises, in particular, identification numbers ("ID numbers") assigned to the individual tools, dimensions of the respective tool in new condition and a regrinding length of the individual tools, i.e., the amount in millimeters that has been removed from the respective tool starting from the new condition, especially owing to wear.

The data inventory of the tool management system 32 can be altered. For example, additional tools may be included in the tool management or tools included may be removed from the inventory. In the case where tools are reprocessed, the grinding length in respect of the relevant tool can be entered and placed in the data memory of the tool management system 32. The regrinding length, for example of dies, can be limited for structural reasons. Once a maximum regrinding length is reached, the tool in question is no longer reprocessed but is removed from the inventory when reprocessing would actually be necessary. In the case of dies having a relief angle, a computer of the tool management system 32 determines the new diameter of the die orifice obtained as a result of the reprocessing by reference to the regrinding length entered and by reference to the value of the relief angle stored in the tool management system 32.

A numerical processing program, e.g., an NC program 33 (FIG. 1), can be created for processing a metal sheet 2 on the punch machine 1. The NC program 33 can then be implemented by means of the CNC control 23 of the punch machine 1. A tool requirements list can also be created. The tool requirements list can include a listing of all the tools required for implementing the NC program 33. To create the tool requirements list, reference is made to the tool data stored in the tool management system 32. If a circular cut-out of diameter d is to be made in a metal sheet 2 of thickness s, a round punch having the nominal diameter d is selected from the tool inventory entered into the tool management system 32. A die having a circular die orifice whose nominal diameter is greater than the nominal diameter d of the punch by s/10 is assigned to that punch from the tool inventory of the tool management system 32. The die selected may be a punching tool in new condition but may also be a reprocessed punching tool whose die orifice has acquired the required nominal diameter only as a result of the removal of material which has occurred during reprocessing.

In the tool requirements list of the NC program 33 the selected punching tools appear with their identification numbers. By reference to those identification numbers, the user of the punch machine 1 is able to assemble the punching tool set defined by means of the data of the tool management system 32 in order to set up the punching apparatus 12. For that purpose, the user takes the punching tools from a stock of tools held, for example, in a tool cabinet.

Figure 6:
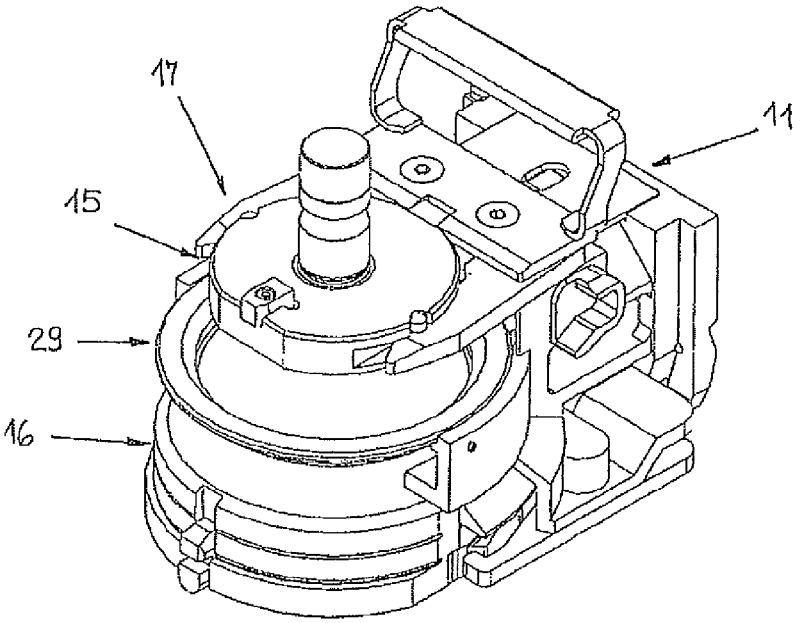
FIG. 6 is a perspective view of a punching tool set.

In the manner shown in FIG. 6, the user arranges the selected punching tool set 17 on a tool holder 11. As shown in FIG. 6, in addition to the punch 15 and the die 16, a stripper 29 is fixed to the tool holder 11. The tool holder 11 together with the punch 15, the die 16 and the stripper 29 is then mounted on the transverse rail 9 of the punch machine 1. The transverse rail 9 is used as a tool magazine. Correspondingly, the remaining magazine stations on the transverse rail 9 are loaded with tool holders 11 and punching tool sets arranged thereon. The distribution of the individual tool holders 11 with the respective punching tool sets among the magazine stations on the transverse rail 9 is defined in the set-up procedure for the punch machine 1.

After setting-up the tool magazine on the transverse rail 9 of the punch machine 1, the first punching tool set 17 to be used in the processing operation to be carried out on the metal sheet is loaded at the punching station 12 of the punch machine 1. The transverse rail 9 travels under numerical control to the punching station 12 where the punch 15 and the die 16 of the first punching tool set 17 are transferred to the upper tool receiver 13 and to the lower tool receiver 14. The stripper 29 is also installed at the punching station 12.

The transverse rail 9 then travels with the then empty tool holder 11 to a position in which the metal sheet 2 to be processed can be gripped by means of the clamps 10 also provided on the transverse rail 9. The situation shown in FIG. 1 is thus obtained. As a result of being loaded into the upper tool receiver 13 and into the lower tool receiver 14, the punch 15 and the die 16 are arranged in a working state. Before processing of the metal sheet is commenced the height of the die 16 can be adjusted. Such a height adjustment may be necessary, such as when the die 16 in question is a reprocessed die and the lower tool receiver 14 is still adjusted to a predecessor die as regards its height setting. In that case, the lower tool receiver 14 can be raised by means of the lower rotary/stroke drive unit 20, acting as an elevating device, by the extent of the material removed in the reprocessing of the predecessor to the die 16. Alternatively, it is possible for a shim for the die 16 to be inserted into the lower tool receiver 14 before the die 16 is loaded, which shim compensates for the material removed.

After the punch 15 and the die 16 have been arranged in a working state, the metal sheet 2 is positioned by means of the coordinate guide 7 and then processed by the punch 15 with one or more working strokes.

Figure 7A:
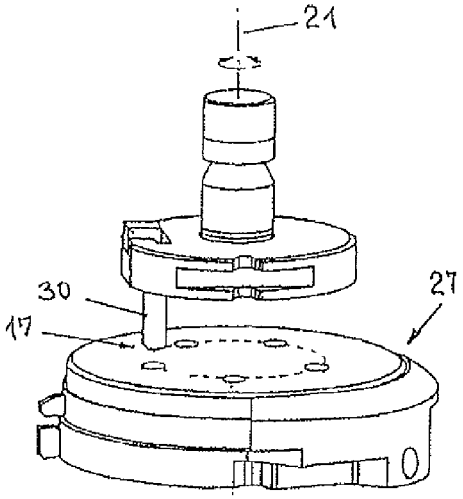
FIGS. 7*a* and 7*b* show a punching tool set composed of a punch and a die of the die assembly of FIGS. 3*a* and 3*b*.
Figure 7B:
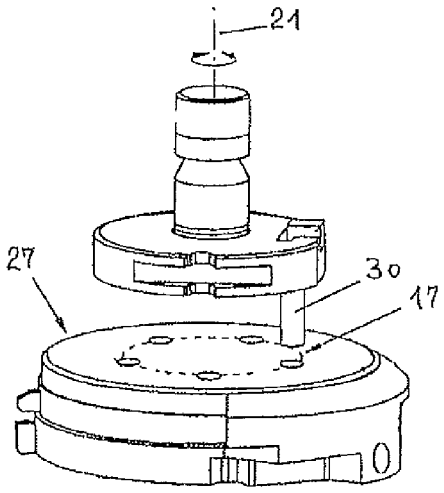

Instead of using the punching tool set 17 shown in FIG. 6, consisting of the punch 15 and the die 16, it is also possible for a punching tool set 17 of the kind shown in FIGS. 7*a* and 7*b* to be employed. That punching tool set 17 comprises one of the dies 27/1 . . . 27/10 of the die assembly 27 shown in FIGS. 3*a* and 3*b* and an eccentric punch 30. For clarity, only five of the total of ten dies 27/1 . . . 27/10 on the die assembly 27 are shown in FIGS. 7*a*, 7*b*.

When defining the punching tool sets 17 composed of the dies 27/1 . . . 27/10 and the eccentric punch 30, reference is made to the tool data of the tool management system 32 available to the punch machine 1. Reprocessing of the die assembly 27 is taken into consideration in the punch assignment and/or in the sheet thickness assignment of the dies 27/1 . . . 27/10 where applicable.

In the manner described above with reference to FIG. 6, the die assembly 27 and the eccentric punch 30 are placed on a tool holder 11 and fixed to the transverse rail 9 of the punch machine 1 by means of the tool holder 11. On movement of the transverse rail 9, the eccentric punch 30 is loaded into the upper tool receiver 13 and the die assembly 27 is loaded into the lower tool receiver 14 of the punching station 12. The vertical position of the die assembly 27 is adjusted, if necessary, by means of the lower rotary/stroke drive unit 20.

After tool loading, the punching tool set shown in FIGS. 7*a* and 7*b* is arranged in a working state by relative movement of the die assembly 27 on the one hand and of the eccentric punch 30 on the other hand. That relative movement involves a relative rotational movement about the stroke axis 21. In the example shown, the relative rotational movement is performed by means of the upper rotary/stroke drive unit 19. The latter is able to move the eccentric punch 30 about the stroke axis 21 to rotational positions in which the eccentric punch 30 is able to cooperate with each of the dies 27/1 . . . 27/10 to process the metal sheet.

Figure 8:
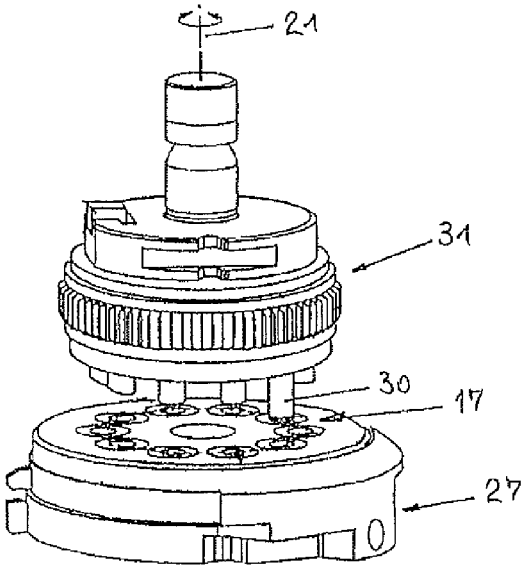
FIG. 8 is a perspective view of a punching tool set composed of a punch of a punch assembly and a die of the die assembly shown in FIGS. 3*a* and 3*b*.

As shown in FIG. 8, the eccentric punch 30 forms part of a punch assembly 31 that cooperates with the die assembly 27. In punching operation, only one of the punches of the punch assembly 31 is activated and assigned to one of the dies 27/1 . . . 27/10 for processing of the workpiece. In the case of the arrangement shown in FIG. 8 also, the punching tool set 17 used for processing of the workpiece is arranged in a working state by relative rotational movement of upper tool (punch 30 of the punch assembly 31) and lower tool (one of the dies 27/1 . . . 27/10 of the die assembly 27).

Other embodiments are within the scope of the following claims.

What is claimed is:

1. A stock of punching tool sets, comprising:

a plurality of punches having different, respective cross-sections; and a die having a height measured in a punch entry direction with respect to the die, the die defining an orifice having a smooth wall that extends in the punch entry direction at an acute relief angle and having a cutting edge that forms a cutting edge cross-section, wherein a first punch of the plurality of punches having a first cross-section and the die in a predecessor state form a first tool set, the first cross-section of the first punch being smaller than the cutting edge cross-section of the die in the predecessor state, and wherein a second punch of the plurality of punches having a second cross-section and the die in a reprocessed state form a second tool set, the second cross-section of the second punch being smaller than a reprocessed cutting edge cross-section of the die in the reprocessed state, and wherein the die, in the reprocessed state, has a reprocessed height that is less than the height of the die in the predecessor state, and the reprocessed cutting edge cross-section of the die in the reprocessed state is larger than the cutting edge cross-section of the die in the predecessor state according to the acute relief angle, such that the second cross-section of the second punch is different from the first cross-section of the first punch.

2. The stock of claim 1, wherein the second cross-section of the second punch is larger than the first cross-section of the first punch.

3. The stock of claim 1, wherein the first and second tool sets are adapted to process workpieces of a same thickness.

4. The stock of claim 1, wherein the first and second tool sets are adapted to process workpieces having different thicknesses.

5. The stock of claim 1, wherein the first and second tool sets are adapted to produce holes in a metal sheet.

* * * * *